US005236384A

United States Patent [19]

Fabricant et al.

[11] Patent Number: 5,236,384

[45] Date of Patent: Aug. 17, 1993

[54] TOY WITH CHANGEABLE COLOR

[76] Inventors: Norman Fabricant; Arlene Fabricant, both of 114 Station Rd., Great Neck, N.Y. 11023; Lawrence Mass, 14 Lincoln Ave., RyeBrook, N.Y. 10573

[21] Appl. No.: 863,421

[22] Filed: Apr. 3, 1992

[51] Int. Cl.[5] ..... A63H 3/52; A63H 3/36; A63F 3/00

[52] U.S. Cl. ..... 446/267; 446/339; 273/291; 273/457

[58] Field of Search ..... 446/267, 4, 6, 14, 195, 446/196, 304, 305, 321, 337, 339, 472, 489; 273/288, 291, 457

[56] References Cited

U.S. PATENT DOCUMENTS

| | | | |
|---|---|---|---|
| 2,502,328 | 3/1950 | Kuhn . | |
| 2,504,653 | 4/1950 | Cohn | 446/304 X |
| 2,931,136 | 4/1960 | Loewy . | |
| 3,237,340 | 3/1966 | Knott | 446/267 |
| 3,842,531 | 10/1974 | Sloan | 446/267 |
| 3,976,219 | 8/1976 | Pagnoni . | |
| 4,332,096 | 6/1982 | Kohner et al. . | |
| 4,805,915 | 2/1989 | Lamie . | |
| 4,941,590 | 7/1990 | Pantaleo et al. | 273/457 X |
| 4,990,119 | 2/1991 | Amici et al. | 446/267 |
| 5,176,561 | 1/1993 | Greenberg et al. | 446/267 |

FOREIGN PATENT DOCUMENTS

| | | | |
|---|---|---|---|
| 697356 | 11/1964 | Canada | 446/267 |
| 704452 | 2/1965 | Canada | 446/267 |
| 380960 | 9/1932 | United Kingdom | 446/304 |
| 436502 | 10/1935 | United Kingdom | 446/267 |

*Primary Examiner*—Robert A. Hafer
*Assistant Examiner*—D. Neal Muir
*Attorney, Agent, or Firm*—Amster, Rothstein & Ebenstein

[57] ABSTRACT

A toy with a portion of apparently changeable color includes a normally upright and invertible elongate figure defining a normally opaque upper chamber and an at least partially transparent normally lower chamber. A valve in the figure is movable between an enabling position and a disabling position to control fluid flow communication between the chambers. A volume of colored fluid is disposed in the figure and capable of flowing between the chambers via the valve under the influence of gravity only when the valve is in the enabling position. A spring biases the valve towards the disabling position, and a manually operable portion moves the valve to the enabling position. Inversion of the figure (so that the normally upper chamber is below the normally lower chamber) and manual operation of the piston moves the value into the enabling position and thereby enables the flow of the volume of fluid under the influence of gravity from the normally lower chamber to the normally upper chamber where the fluid is visible through the transparent portion.

18 Claims, 3 Drawing Sheets

TOY WITH CHANGEABLE COLOR

BACKGROUND OF THE INVENTION

The present invention relates to a toy, such as a hand-held toy figure, and more particularly to such a toy which has a portion of apparently changeable color.

Conventional toy figures frequently have moving parts (e.g., limbs), voice and/or sound capabilities, and the like. Generally such toy figures do not apparently change color, even though a change of color might provide to a child a "play value" equivalent to the movement of parts, sound generation, or the other elements capable of providing play value to the toy figure. In those toys which do change color, such as "mood rings" wherein the color of a stone varies with various physiological indicators of the wearer's mood, the color change is not under the conscious control of the wearer to any substantial degree.

While a collection of toy figures would be incomplete without at least one "vampire bat" or like "blood-sucking" character, the known "vampire bat" toys afford only a modest play value since they do not focus attention on the "blood-sucking" feature of the character.

Accordingly, it is an object of the present invention to provide a toy having a portion of apparently changeable color.

Another object is to provide such a toy in the nature of a "vampire bat" character wherein at least a portion thereof can be made to change color under the conscious control of the person playing therewith.

A further object is to provide such a toy having the appearance of a "vampire bat."

SUMMARY OF THE INVENTION

It has now been found that the above and related objects of the present invention are obtained in a toy with a portion of apparently changeable color. The toy comprises a normally upright and invertible elongate figure defining a normally upper chamber and a normally lower chamber, the normally lower chamber being effectively opaque and at least a portion of the normally upper chamber being transparent. Valve means are provided in the figure for controlling fluid flow communication between the chambers, the valve means being movable between an enabling position enabling such fluid flow communication and a disabling position disabling the fluid flow communication. A volume of fluid (colored differently than the transparent portion of the normally upper chamber) is disposed in the figure and capable of flowing between the chambers via the valve means under the influence of gravity only when the valve means is in the enabling position. The toy additionally includes means for biasing the valve means towards the disabling position, and manually operable means for moving the valve means to the enabling position. Manual operation of the manually operable means while the figure is in an upright orientation moves the valve means into the enabling position and thereby enables the flow of the volume of fluid under the influence of gravity from the normally upper chamber into the normally lower chamber so that the fluid is no longer visible through the transparent portion.

Inversion of the figure (so that the normally upper chamber is below the normally lower chamber) and manual operation of the manually operable means moves the valve means into the enabling position and thereby enables the flow of the volume of fluid under the influence of gravity from the normally lower chamber to the normally upper chamber where the fluid is visible through the transparent portion.

Re-inversion of the figure (so that the normally upper chamber is above the normally lower chamber) and non-actuation of the manually operable means allows the biasing means to move the valve means into the disabling position and thereby maintains the volume of fluid in the normally upper chamber where it is visible through the transparent portion.

In a preferred embodiment, the figure generally resembles a vampire bat and the normally upper chamber has the appearance of a head while the normally lower chamber has the appearance of a headless body. The fluid is typically red, and the transparent portion is non-red (preferably clear and uncolored) when the fluid is not in the normally upper chamber.

Preferably the manually operable means may be separately actuated either by movement of the inverted figure downwardly against a fixed surface or by movement of the manually operable means downwardly on the upright figure.

The toy may be configured and dimensioned for use as a game piece wherein the game piece is deemed to be "in" or "out" of the game depending upon the color visible through the transparent portion.

The manually operable means includes a control element for moving the valve means to the enabling position, the element being movable between a first position remotely spaced from the normally upper chamber and a second position wherein the element is adjacent (e.g., in contact with) the normally upper chamber. In the upright figure the element in the first position is remotely spaced above the normally upper chamber and in the second position is proximately spaced above the normally upper chamber. The element is disposed on the top of the normally upper chamber as a partial covering therefor (e.g., as hair or a hat). Means bias the element to the first position, and the element is in operative communication with the valve means through the normally upper chamber.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein.

It will be appreciated that the stippling represents a fluid of a first color, such as red, which contrasts with the color of the transparent portion of the face.

DETAILED DESCRIPTION OF THE PREFERRED EMBODIMENTS

Figure 2:
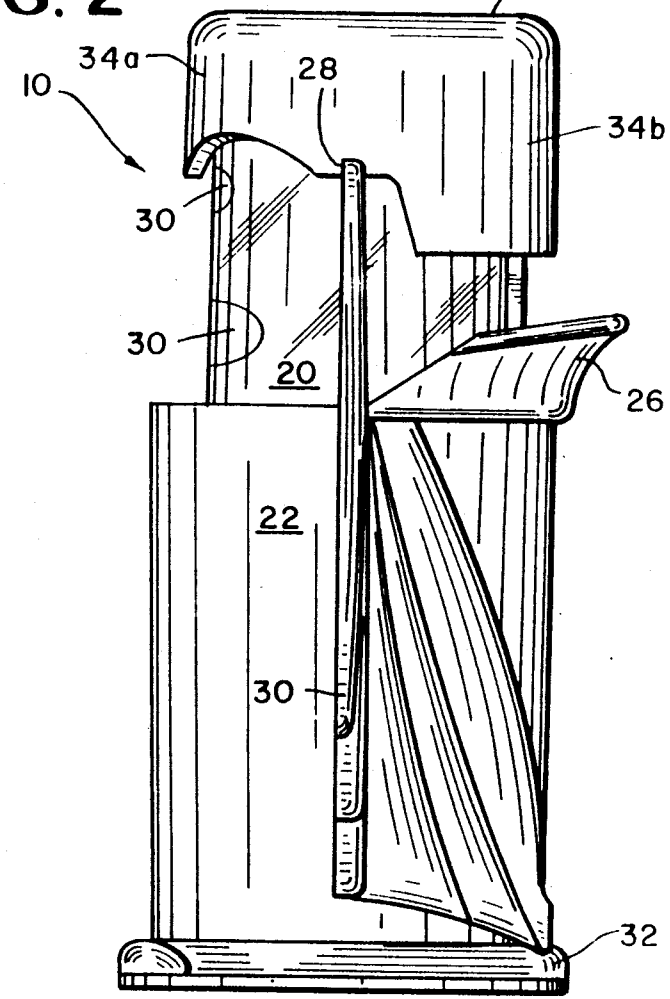
FIG. 2 is a side elevational view thereof.
Figure 1:
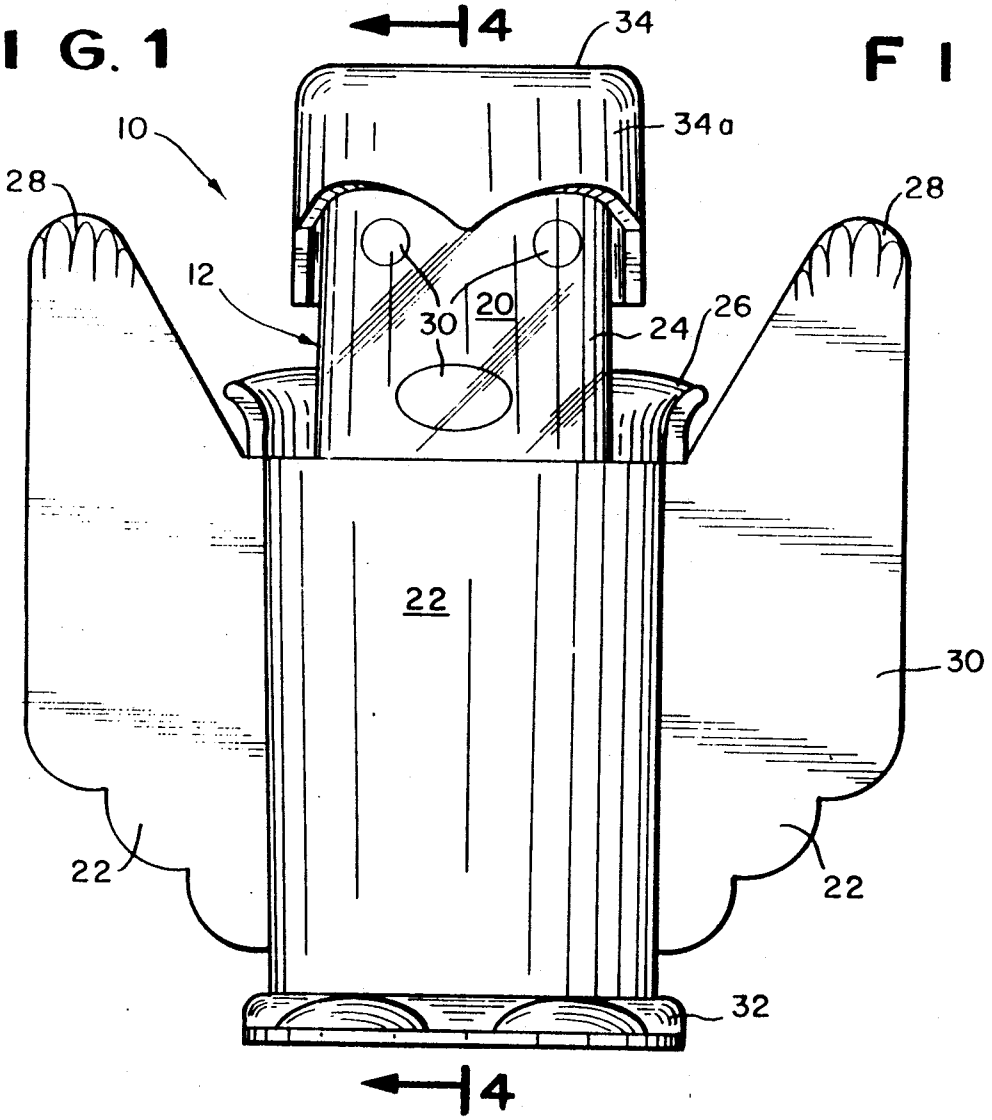
FIG. 1 is a front elevational view of a toy according to the present invention in the form of a "vampire bat"
Figure 6:
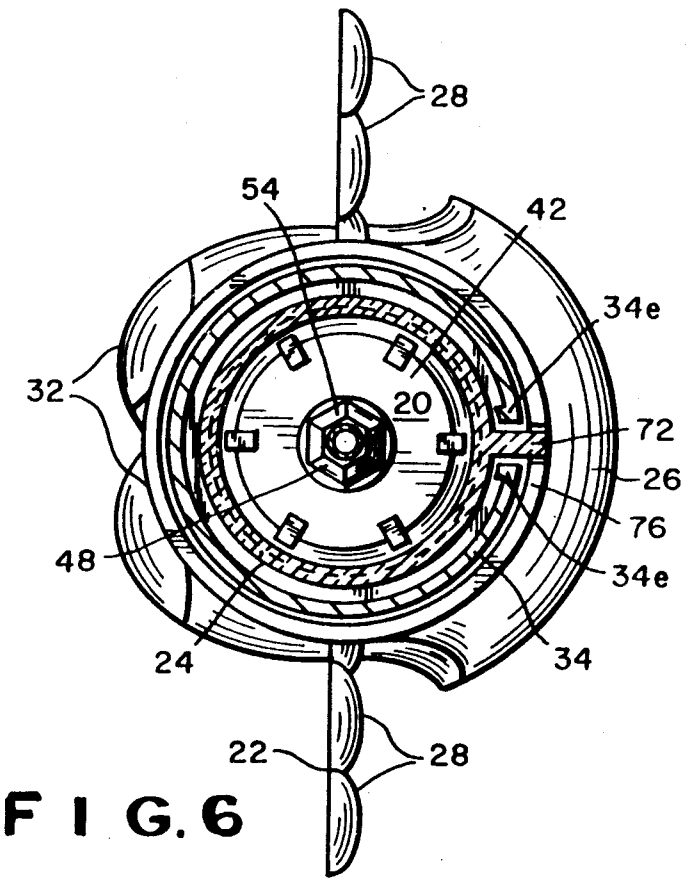
FIG. 6 is a sectional view taken along the line 6—6 of FIG. 5.
Figure 3:
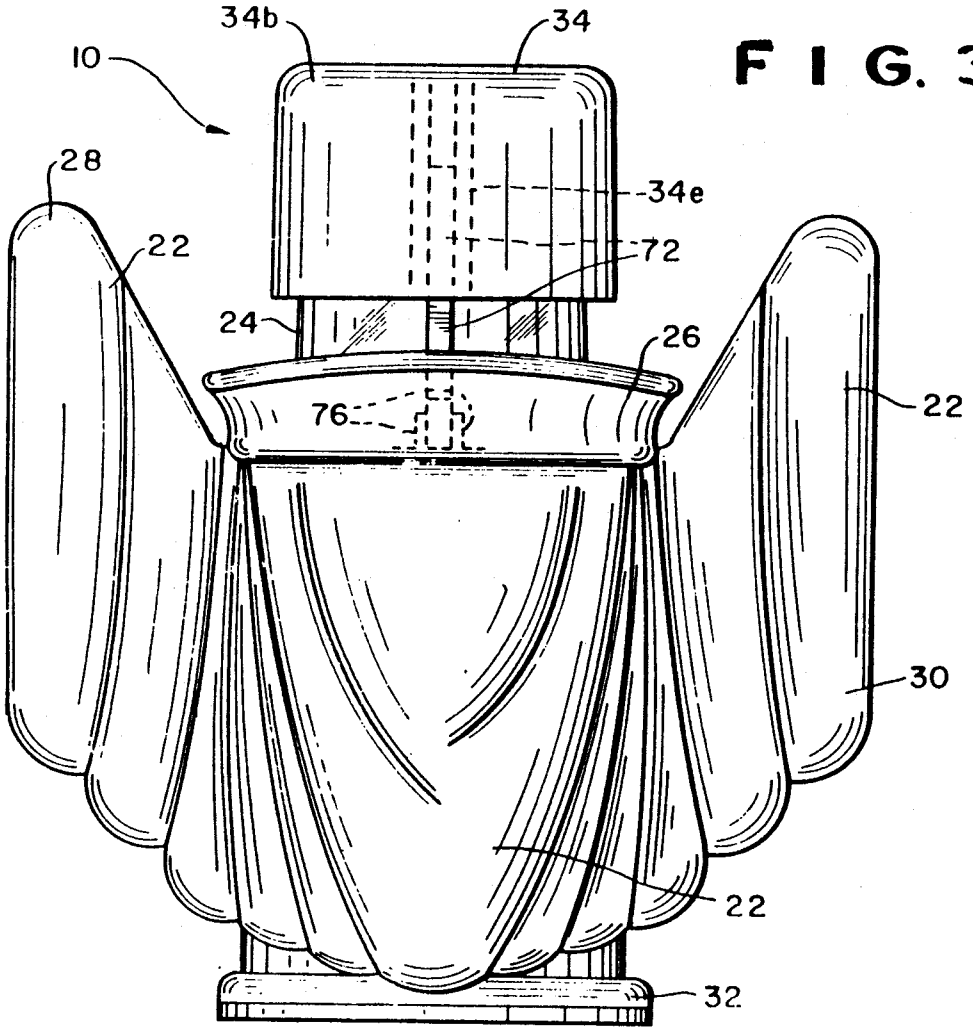
FIG. 3 is a rear elevational view thereof.

Referring now to the drawing, and in particular to FIGS. 1–3 thereof, therein illustrated is a toy according to the present invention, generally designated by the reference numeral 10. The toy 10 comprises a normally upright and invertible elongate figure generally designated 12 defining a normally upper chamber 20 and a normally lower chamber 22. As illustrated, the overall FIG. 12 generally resembles both a vampire bat with upraised wings and a caped bat-like figure having upraised hands. The normally upper chamber 20 has the appearance of a head, and the normally lower chamber 22 has the appearance of a headless body or torso.

While the normally lower chamber 22 is effectively opaque, at least a portion 24 of the normally upper chamber 20 is transparent. It will be appreciated that, as illustrated, the normally lower chamber 20 may be as transparent as the normally upper chamber portion 24, but with an opaque covering provided thereon to cover the normally lower chamber 22 in its entirety. The lower chamber 22 or its opaque covering may further have portions extending outwardly to the sides of the normally lower chamber 22 and even thereabove so as to convey the impression of a collar 26 and upraised wings or arms 28, the visible outer surface thereof also defining, perhaps, a jacket, belt and pants for the figure. The opaque covering may consist simply of printed paper glued or otherwise secured to the chamber, although the portions thereof which are cantilevered outwardly are preferably reenforced (for example, by plastic) to prevent tearing thereof during normal abusive handling by children.

An opaque covering 30 may also be disposed over selected portions of the normally upper chamber 20 to assist in defining the same as a head, perhaps, by portraying glasses, a nose or teeth, as desired. Any portions of the opaque covering 30 disposed on the normally upper chamber 20 may be either connected to or separate from the portions of any opaque covering about the normally lower chamber 22.

The normally lower chamber 22 may define a mounting base 32 which, in turn, may define feet or shoes for the figure. Disposed on the upper surface of the normally upper chamber 20 is a top covering 34 which may have the appearance of hair, a hat, a cap, a helmet or the like.

Figure 5:
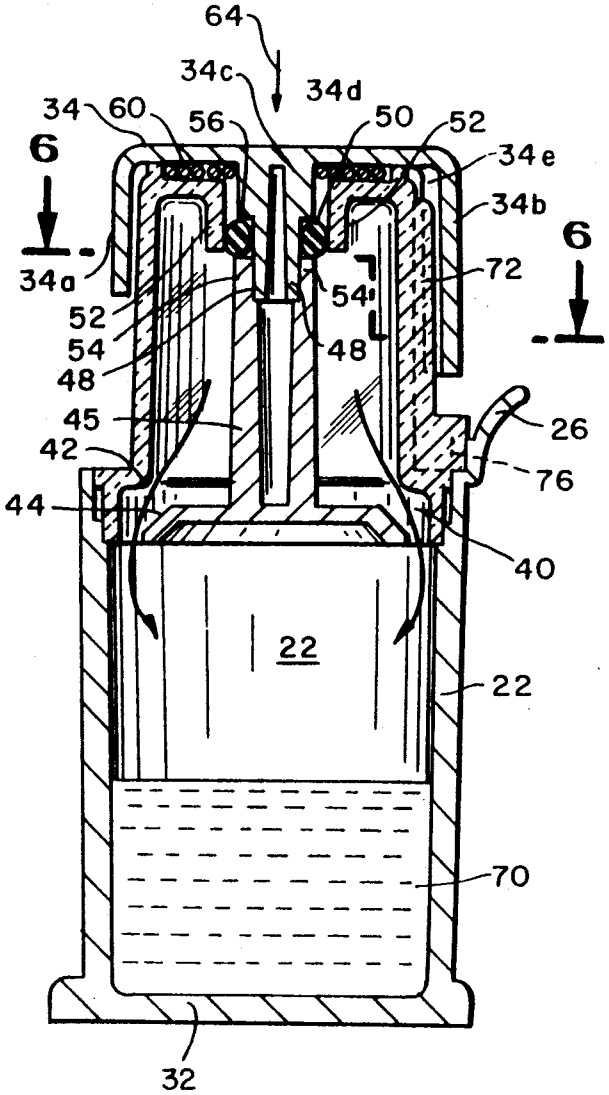
FIG. 5 is a sectional view similar to that of FIG. 4, but with the valve in the enabling position.
Figure 4:
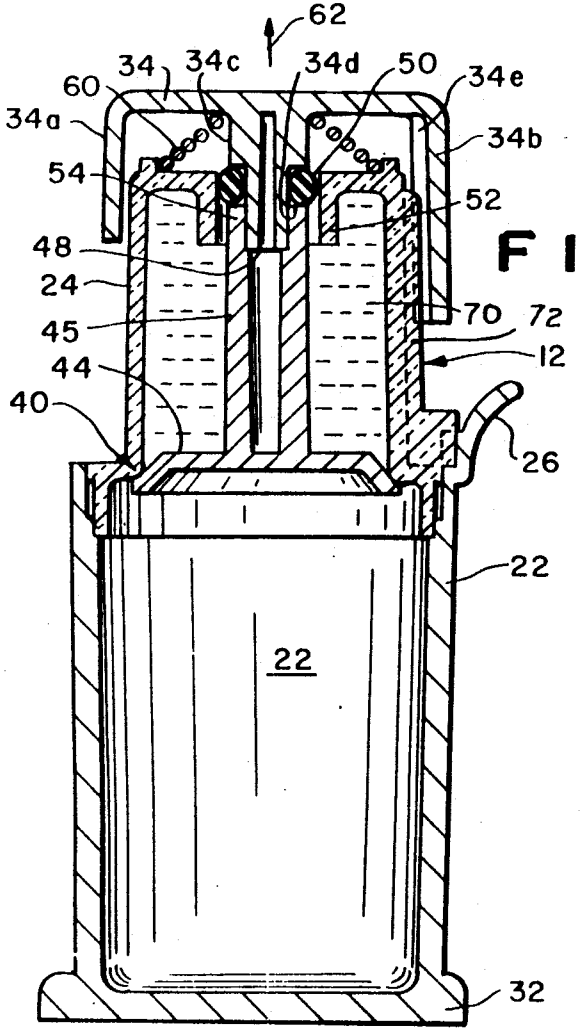
FIG. 4 is a sectional view thereof, taken along the line 4—4 of FIG. 1, with the valve in the disabling position.

Referring now to FIGS. 4 and 5 as well, valve means 40 are disposed in FIG. 12 for controlling fluid flow communication between the chambers 20, 22. More particularly, the valve means 40 comprises a seat 42 in the region of the intersection between the chambers 20, 22 and a piston 44 movable between an enabling position enabling such fluid flow communication between the chambers 20, 22 and a disabling position disabling such fluid flow communication between the chambers 20, 22. FIG. 4 illustrates the valve means 40 in the disabling position, while FIG. 5 illustrates the valve means 40 in the enabling position. A piston rod 45 is secured to the piston 44 for movement therewith and extends upwardly through the normally upper chamber 20.

Movement of the valve means 40 (and more particularly piston 44 and piston rod 45) between the enabling and disabling positions is effected by means of the top covering 34. As illustrated, the top covering 34 includes a short front downwardly-extending flange **34*a*, a longer rear downwardly-extending flange 34*b* and a connecting portion 34*c* which connects flanges 34*a* and 34*b* and extends downwardly through the top of the normally upper chamber 20 and is secured at its free end 48 to the top of piston rod 45. Obviously other configurations of top covering 34 may also be employed. The top covering 34 is movable between a first position wherein the horizontal top portion 34*c* thereof is remotely spaced from the horizontal top portion of the normally upper chamber 20 (as illustrated in FIG. 4) and a second position wherein the horizontal top portion 34*c* thereof is more closely adjacent the horizontal top portion of the normally upper chamber 20. An O-ring 50 is disposed within the normally upper chamber 20 intermediate adjacent portions of the normally upper chamber 20 (such as flanges 52), the piston rod 45 (such as piston rod upper end 54), and the top covering connecting portion 34*c* (such as portion shoulders 45**) in order to render this junction fluidtight.

A biasing means 60, such as a conical compression spring, is disposed intermediate the top of the normally upper chamber 20 and the bottom of the horizontal portion **34*c* of the top covering 34 in order to bias the top covering 34 upwardly relative to the normally upper chamber 20 (when the figure is in the upright orientation), thereby moving piston 44 to its disabling position, as illustrated in FIG. 4. In other words, under the influence of biasing means 60, acting through top covering 34, the valve means 40 is biased (in the direction of arrow 62 of FIG. 4) into a disabling position by causing valve piston 44 to contact valve seat 42, thereby precluding fluid flow communication between the chambers 20, 22. On the other hand, when the top covering 34 is manually moved closer to the normally upper chamber 20 (in the direction of arrow 64 of FIG. 5)—e.g., by a downward movement of the top covering 34 when the figure is in the upright orientation—the top covering 34 moves piston 44 to its enabling position away from valve seat 42, thereby enabling fluid flow communication between the chambers 20, 22**.

To recapitulate, the top covering 34 acts as a manually operable control element for moving the valve means 40 to the enabling position illustrated in FIG. 5, the top covering 34 being biased by spring 60 to the first position. When the FIG. 12 is in the upright orientation, the top covering 34 in the first position is remotely spaced above the normally upper chamber 20 (so that valve means 40 is in the disabling position) and in the second position is proximately or closely spaced above the normally upper chamber 20 (so that valve means 40 is in the enabling position).

A volume of fluid 70 colored differently than the transparent portion 24 of the normally upper chamber 20 is disposed within the FIG. 12 and capable of flowing between the chambers 20, 22 via the valve means 40 under the influence of gravity only when the valve means 40 is in the enabling position (that is, when the valve piston 44 is spaced from the valve seat 42). Preferably the fluid 70 is a liquid so that the fluid flow communication between the chambers 220, 22 under the control of the valve means 40 is liquid flow communication. For a "vampire bat" figure, the fluid is preferably colored red, while the transparent portion 24 of the normally upper chamber is non-red when the fluid 70 is not in the normally upper chamber 20. For example, the transparent portion 24 may be clear and uncolored (untinted).

In order to prevent relative rotation of the top covering 34 and the normally upper chamber 20 upon which it is mounted, the top covering 34 defines a keyway **34*e* adapted to receive a key 72 extending vertically on the sidewall of the normally upper chamber 22. The key/keyway arrangement 72, 34*e* maintains the top covering 34** appropriately oriented on the normally upper chamber 20 so that it looks like the intended hair, cap or the like as well as preventing possible damage to the spring 60 due to relative rotation of the top covering 34 and normally upper chamber 20. The key 72 of the normally upper chamber 20 preferably further extends downwardly and is received in a keyway 76 of the covering 30, thereby ensuring that the relative rotational orientation of the top covering 34 and the covering 30 is maintained (as illustrated in FIGS. 3–5).

Operation of the toy 10 is simple. Inversion of the FIG. 12 so that the normally upper chamber 20 is below the normally lower chamber 22 and manual operation of the manually operable top covering 34 moves the valve means 40 into the enabling position (illustrated upside down in FIG. 5) and enables the flow of the volume of fluid 70 under the influence of gravity from the normally lower chamber 22 (now the upper chamber) to the normally upper chamber 20 (now the lower chamber), where the fluid 70 becomes visible through the transparent portion 24. At this point, the top covering 34 is released and the FIG. 12 may be re-inverted so that the normally upper chamber 20 is once against above the normally lower chamber 22. As long as the manually operable top covering 34 is not actuated, the biasing means 60 moves the valve means 40 into its disabling position and maintains it there, thereby maintaining the volume of fluid 70 in the normally upper chamber 20, where it is visible through the transparent portion 24. Thus the FIG. 12 appears as an upright vampire bat whose face is red, flush with recently consumed blood.

Manual operation (i.e., depression) of the manually operable to covering 34 while the FIG. 12 is re-inverted or upright moves the valve means 40 into the enabling position (illustration in FIG. 5) and thereby enables the flow of the volume of the fluid 70 under the influence of gravity from the normally upper chamber 20 into the normally lower chamber 22, so that the fluid is no longer visible through the transparent portion 24. At this point, the FIG. 12 has the appearance of an upright vampire bat which has not recently consumed blood and, accordingly, has a pale, anemic face.

It will be readily appreciated by those skilled in the game art that the toy may be configured and dimensioned for use as a game piece wherein the game piece is deemed to be "in" or "out" of the game depending upon the color visible through the transparent portion 24. For example, the figure with a red face (indicating a recent consumption of blood) may be deemed to be "in," and the figure with a pale or transparent face (indicating the absence of a recent feeding on blood) may be deemed to be "out." A variety of different games may employ a toy according to the present invention as a game piece. For example, the toy pieces may be used as checker pieces with the color of the top coverings 34 indicating one side or the other. The game would start with all pieces having recently fed—that is, with red faces. A player in the process of "capturing" an opponent's game piece could simply hold his game piece in his hand (without depressing the manually operable top covering 34 thereof) and use the base 32 of his game piece to depress the top covering 34 of his opponent'captured game piece. The face of the opponent's game piece would rapidly turn non-red as the fluid 70 flowed through the open valve means 40 from the normally upper chamber 20 into the normally lower chamber 22 under the influence of gravity. After the move has been completed, the captured game piece with the pale face would be removed from the board. There could be no question as to which pieces had been captured since the captured pieces would have pale faces. At the end of the game, all of the captured pieces would be inverted and pressed against a substrate (e.g., a table top) so that the top covering 34 is moved closely adjacent the normally upper chamber 20 (now the bottom chamber) so as to open valve means 40 and allow fluid 70 to flow under the influence of gravity back into the normally upper chamber 20.

It will be appreciated that the valve means 40 may be opened either by simply depressing the manually operable top covering 34 of an upright FIG. 12 or by downward movement of an inverted FIG. 12 while the top covering 34 abuts a stationary surface (such as a table).

To summarize, the present invention provides a toy having a portion of apparently changeable color, the toy typically being in the nature of a "vampire bat" character wherein at least a portion thereof can be made to change color under the conscious control of person playing therewith so that the toy has the appearance of a "vampire bat" which has either recently fed on blood so that the changeable color portion is red or not recently fed on blood so that the changeable color portion is pale.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

We claim:

1. A toy with a portion of apparently changeable color comprising:

(A) a normally upright and invertible elongate figure defining a normally upper chamber and a normally lower chamber, said normally lower chamber being effectively opaque and at least a portion of said normally upper chamber being transparent;

(B) valve means in said figure for controlling fluid flow communication between said chambers, said valve means being movable between an enabling position enabling such fluid flow communication and a disabling position disabling such fluid flow communication;

(C) a volume of fluid colored differently than said transparent portion of said normally upper chamber disposed in said figure and capable of flowing between said chambers via said valve means under the influence of gravity only when said valve means is in said enabling position;

(D) means for biasing said valve means towards said disabling position; and (E) manually operable means including a control element for moving said valve means to said enabling position, said element being movable between a first position remotely spaced from said normally upper chamber and a second position adjacent said normally upper chamber;

whereby manual operation of said manually operable means while said figure is in an upright orientation with said normally upper chamber above said normally lower chamber moves said valve means into said enabling position and thereby enables the flow of said volume of fluid under the influence of gravity from said normally upper chamber into said normally lower chamber so that the fluid is no longer visible through said transparent portion.

2. The toy of claim 1 wherein said fluid is a liquid and said fluid flow communication is liquid flow communication.

3. The toy of claim 1 wherein said fluid is red.

4. The toy of claim 1 wherein said normally upper chamber has the appearance of a head and said normally lower chamber has the appearance of a headless body.

5. The toy of claim 1 wherein said fluid is red, and said transparent portion is non-red when said fluid is not in said normally upper chamber.

6. The toy of claim 1 wherein said transparent portion is clear and uncolored.

7. The toy of claim 1 wherein said figure generally resembles a vampire bat.

8. The toy of claim 1 wherein said manually operable means may be separately actuated both by movement of said inverted figure downwardly against a fixed surface and by movement of said manually operable means downwardly on said upright figure.

9. The toy of claim 1 configured and dimensioned for use as a game piece wherein the game piece is deemed to be "in" or "out" of the game depending upon the color visible through said transparent portion.

10. The toy of claim 1 wherein in said upright figure said element in said first position is remotely spaced above said normally upper chamber and in said second position is proximately spaced above said normally upper chamber.

11. The toy of claim 10 wherein in said upright figure said element is disposed on the top of said normally upper chamber as a partial covering therefor.

12. The toy of claim 10 additionally including means biasing said element to the first position.

13. The toy of claim 1 wherein said element is in operative communication with said valve means through said normally upper chamber.

14. The toy of claim 1 wherein inversion of said figure so that said normally upper chamber is below said normally lower chamber and manual operation of said manually operable means moves said valve means into said enabling position and thereby enables the flow of said volume of fluid under the influence of gravity from said normally lower chamber to said normally upper chamber where the fluid is visible through said transparent portion.

15. The toy of claim 14 wherein re-inversion of said figure to an upright orientation so that said normally upper chamber is above said normally lower chamber and non-actuation of said manually operable means allows said biasing means to move said valve means into said disabling position and thereby maintains said volume of fluid in said normally upper chamber where it is visible through said transparent portion.

16. The toy of claim 1 wherein re-inversion of said figure to an upright orientation so that said normally upper chamber is above said normally lower chamber and non-actuation of said manually operable means allows said biasing means to move said valve means into said disabling position and thereby maintains said volume of fluid in said normally upper chamber where it is visible through said transparent portion.

17. The toy of claim 1 wherein said chambers are rigid, and said valve means directly controls the fluid flow communication between said chambers.

18. A toy with a portion of apparently changeable color comprising:

(A) a normally upright and invertible elongate figure resembling a character and defining a normally upper chamber having the appearance of a head and a normally lower chamber having the appearance of a headless body, said normally lower chamber being effectively opaque and at least a portion of said normally upper chamber being transparent;

(B) valve means in said figure for controlling fluid flow communication between said chambers, said valve means being movable between an enabling position enabling such liquid flow communication and a disabling position disabling such liquid flow communication;

(C) a volume of liquid colored differently than said transparent portion of said normally upper chamber disposed in said figure and capable of flowing between said chambers via said valve means under the influence of gravity only when said valve means is in said enabling position;

(D) means for biasing said valve means towards said disabling position; and (E) manually operable means for moving said valve means to said enabling position including a control element movable between a first position remotely spaced above said normally upper chamber and a second position wherein said element is adjacent said normally upper chamber;

whereby inversion of said figure so that said normally upper chamber is below said normally lower chamber and manual operation of said manually operable means moves said valve means into said enabling position and thereby enables the flow of said volume of liquid under the influence of gravity from said normally lower chamber to said normally upper chamber where the liquid is visible through said transparent portion;

re-inversion of said figure so that said normally upper chamber is above said normally lower chamber and non-actuation of said manually operable means allows said biasing means to move said valve means into said disabling position and thereby maintains said volume of liquid in said normally upper chamber where it is visible through said transparent portion; and manual operation of said manually operable means while said figure is re-inverted or upright moves said valve means into said enabling position and thereby enables the flow of said volume of liquid under the influence of gravity from said normally upper chamber into said normally lower chamber so that the liquid is no longer visible through said transparent portion.

* * * * *